US006033093A

United States Patent [19]

Latsis et al.

[11] Patent Number: 6,033,093

[45] Date of Patent: Mar. 7, 2000

[54] OUTDOOR LIGHTING DEVICE

[75] Inventors: Chris Latsis; Wai-Lam Chu, both of San Leandro, Calif.

[73] Assignee: Precolite-Moldcast Lighting Company, San Leandro, Calif.

[21] Appl. No.: 09/002,458

[22] Filed: Jan. 2, 1998

[51] Int. Cl.[7] ..... F21V 13/04

[52] U.S. Cl. ..... 362/304; 362/307; 362/327; 362/346

[58] Field of Search ..... 362/297, 298, 362/301, 302, 304, 307, 327, 333, 346, 348, 299

[56] References Cited

U.S. PATENT DOCUMENTS

| | | | |
|---|---|---|---|
| 1,976,163 | 10/1934 | Exelmans | 362/327 |
| 2,220,298 | 11/1940 | Stair et al. | 362/304 |
| 4,001,576 | 1/1977 | Goddard . | |
| 4,096,555 | 6/1978 | Lasker . | |
| 4,186,433 | 1/1980 | Baldwin | 362/307 |
| 4,463,410 | 7/1984 | Mori . | |
| 4,591,960 | 5/1986 | Jones . | |
| 5,414,606 | 5/1995 | Weingartner | 362/307 |

*Primary Examiner*—Y. Quach
*Attorney, Agent, or Firm*—Theodore J. Bielen, Jr.

[57] ABSTRACT

A lighting device employing a source of light which emanates to a first reflector which is positioned outwardly from such source. A second reflector at least partially surrounds the light source and is formed in spaced relationship with the first reflector to create a first gap between the first and second reflectors. The second reflector includes an opening which permits light from the source to pass to the first reflector and outwardly from the lighting device through the first gap. A light interacting element is formed outwardly from the source and is spaced from the second reflector to form a second gap. The second reflector is, thus, positioned between the first reflector and the light interacting element. Light interacting element further receives light from the source and either reflects or diffuses light outwardly from the lighting device.

11 Claims, 2 Drawing Sheets

OUTDOOR LIGHTING DEVICE

BACKGROUND OF THE INVENTION

The present invention relates to a novel and useful lighting device which is particularly adaptable to outdoor "pedestrian scale" lighting environments.

Outdoor lighting often requires projection of light from a source in various directions and at various intensities. In addition, lighting fixtures used in outdoor lighting situations must possess precision cutoff angles and symmetrical or asymmetrical light distribution characteristics to permit placement of such lighting fixtures along streets, sidewalks, roadways, and the like. It is also important in such outdoor lighting devices to control glare, which is highly undesirable.

In the past, outdoor lighting units have been proposed which use reflectors of varying sizes and configurations to propagate light in a desired manner. For example, U.S. Pat. Nos. 4,001,576 and 4,463,410 represent such light altering elements.

Certain lighting fixtures have also employed the use of multiple reflectors spaced from one another about a central source to throw light outwardly at various angles and intensities in outdoor lighting situations. U.S. Pat. No. 4,096,555 and 4,591,960 represent such lighting fixtures having controlled intensity at various angles from the source. These fixtures tend to be bulky and not susceptible to reduction in size for pedestrian use. Also, such fixtures may produce high angle glare above normal viewing angles that is not acceptable at lower mounting heights.

An outdoor lighting fixture which is compact and precise in light distribution from a source would be a notable advance in the field of illumination.

SUMMARY OF THE INVENTION

The present invention relates to a novel outdoor lighting device.

The lighting device of the present invention utilizes a first reflector which is positioned outwardly from a source of light. The source of light may take the form of any incandescent, fluorescent, gas-discharge, or like type of lighting. The first reflector may be positioned outwardly from the source and include an opening therethrough to allow light, from the source, to shine directly outwardly with or without reflection by the first reflector.

A second reflector is also provided in the present invention and at least partially surrounds the light source. The second reflector is also spaced from the first reflector to form a first gap therebetween. The second reflector receives light from the source and directs such light away from the first reflector. In addition, the second reflector includes an opening permitting the passage of light directly from the source to the first reflector for direction therefrom through the first gap between the first and second reflectors. The second reflector may also include a reflecting surface that follows a geometric curve, such as a parabola, and is fluted or possesses a series of ridges and valleys adjacent one another around the source. The fluted surface functions to receive light from the source and to send such light outwardly without directing light directly back to the source. Thus, the second reflector is efficient by not returning light to the source which can lead to overheating of the source. Where the source is an HPS (High Pressure Sodium) source, the life of such lamp is not affected. In addition, the second reflector may be formed with a flange to serve as a cut off of light flowing therefrom.

A light interacting element, such as a distributing reflector, is also used in the present invention and is positioned outwardly from the source of light in a spaced relationship with the second reflector. Thus, the second reflector would lie between the first reflector and such light interacting element. A second gap is formed between the second reflector and the light interacting element to allow light passing beyond the flange of the second reflector to be thrown outwardly from the lighting device of the present invention. The light interacting element may serve a dual purpose of reflecting light through an opening formed thereby, or of diffusing light through its walls. Moreover, a third reflector may be formed and be supported by the light interacting element to receive light from the source and reflect the same through the second gap between the second reflector and the light interacting element.

Light shields in the form of diffusers or reflectors may be placed in the second reflector in order to direct light asymmetrically from the lighting device of the present invention. Such light shields are specially useful in curbside applications where more light must be thrown onto a roadway than to the homes lining the road. In many cases, a plurality of light shields may be employed, one light shield being larger than the other, in order to achieve such an asymmetrical light distribution.

Moreover, a transparent or translucent globe may be placed over the lighting device of the present invention to further diffuse light therefrom. Such globes may be constructed with particularity to the present fixture or retrofitted from existing lighting fixtures.

It may be apparent that a novel and useful lighting device for outdoor lighting environments has been described.

It is therefore an object of the present invention to provide an outdoor lighting device which is compact and is precise in directing light in a symmetric or asymmetrical manner from a source of light.

Another object of the present invention is to provide an outdoor lighting device which is capable of throwing light at high angles from a source without glare.

A further object of the present invention is to provide an outdoor lighting device which utilizes a plurality of reflectors and at least one diffuser in combination.

Yet another object of the present invention is to provide an outdoor lighting device having a minimum number of reflector elements to produce symmetrical or asymmetrical distribution of light without glare.

Another object of the present invention is to provide an outdoor lighting device which employs lighting sources of relatively small wattage in comparison to the illumination intensity projected from the fixture.

The invention possesses other objects and advantages especially as concerns particular characteristics and features thereof which will become apparent as the specification continues.

Figure 3:
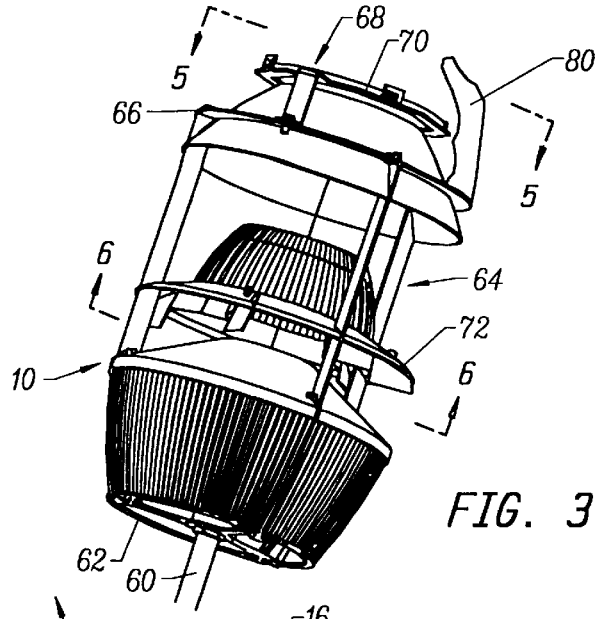
FIG. 3 is a bottom perspective view of the lighting fixture of the present invention.

For a better understanding of the invention reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be referenced to the hereinabove described drawings.

The invention as a whole is shown in the drawings by reference character 10. Lighting device 10 includes as one of its elements a first reflector 12 having an inner reflecting surface 14. First reflector 12 is generally cone shaped although the outer walls thereof have a slightly curved configuration. First reflector 12 may be constructed of any suitable material such as metal, ceramic composition, and the like. First reflector 12 includes an upper opening 16 and a lower opening 18. Light may pass directly through opening 16, which also serves to provide access for servicing device 10, such as replacing source 36.

Figure 2:
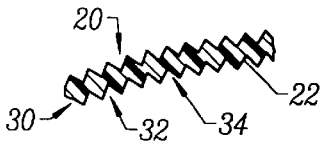
FIG. 2 is a partial sectional view of the wall of the second reflector.

Second reflector 20 is also illustrated in the present invention. Second reflector 20 includes an inner reflecting surface 22. Second reflector 20 is formed of first curved portion 24 and second curved portion 26. First curved portion 24 may be parabolic to direct light outwardly. Second curved portion 26 may include an edge which serves as a cut off to control glare. With reference to FIG. 2, it may be observed that the wall portion 30 of second reflector 20 includes a fluted configuration, having a plurality of peaks 32 and valleys 34 adjacent one another on the inner surface 22. This structure prevents light emanating from source 36 from being reflected back thereto. Source 36 may be an incandescent, fluorescent, HPS or other light source known in the art. Second reflector 20 includes an opening 38 above source 36 and another opening 40 below source 36.

Figure 4:
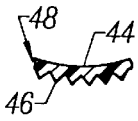
FIG. 4 is a sectional view of the light interacting element of the lighting device of the present invention.

Again referring to FIGS. 1 and 3, it may be observed that the present invention also includes a light interacting element or distributing reflector 42, which possesses a relatively smooth inner surface 44 and a fluted or ridged outer surface 46, FIG. 4. Wall portion 48 of light interacting element 42 is translucent. That is to say, light passing therethrough is diffused to a certain degree to create a glow. It should also be noted that inner surface 44 of light interacting element is capable of reflecting light. Socket 50 for lighting source 36 is also found at least partially within light interacting element 42. Rays 51 emanating from light source 36 are capable of reflecting off of socket 50 by constructing socket 50 of reflecting material or using a conventional socket with reflecting shield thereabout. Light interacting element 42 is spaced from second reflector 20 to form a second gap 52 therebetween.

Third reflector 54 is connected to the edge portion 56 of light interacting element 42. Reflector 54 is angled inwardly toward light source from light interacting element and includes a reflecting surface 58 which is capable of directing light from source 36 outwardly through second gap 52.

Device 10 may be connected to shaft 60, FIG. 3 via a spider support 62. A plurality of bars 64 extend to spider 62 and hold a ring 66 about first reflector 12. Plurality of bars 64 may extend further downwardly to a mounting base (not shown). A plurality of bars 68 converge to another ring 70 at the very top of first reflector 12. Flange 72 generally surrounds second reflector 20 and are connected to plurality of bars 64 to complete the support structure for device 10.

Figure 5:
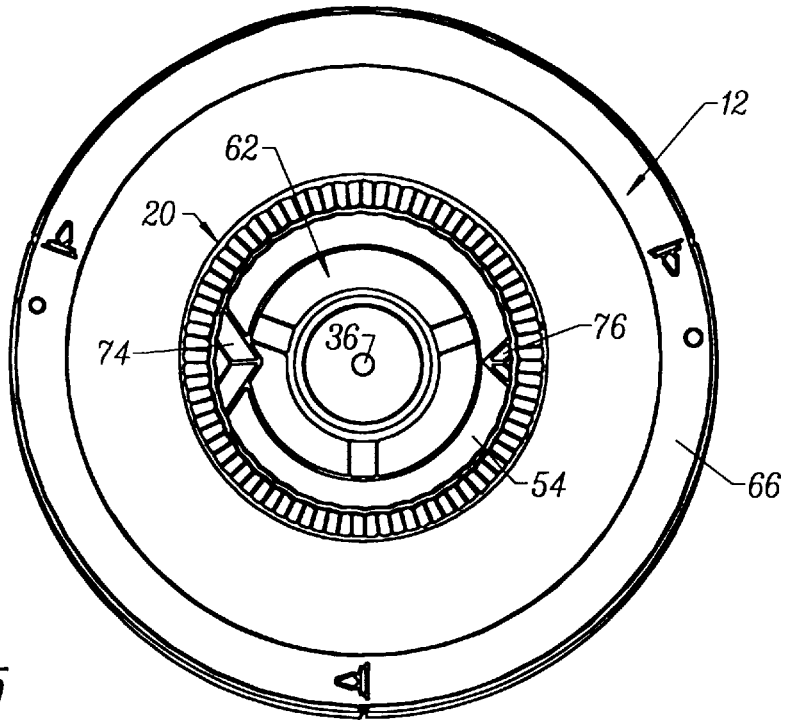
FIG. 5 is a sectional view taken along line 5—5 of FIG. 3.
Figure 6:
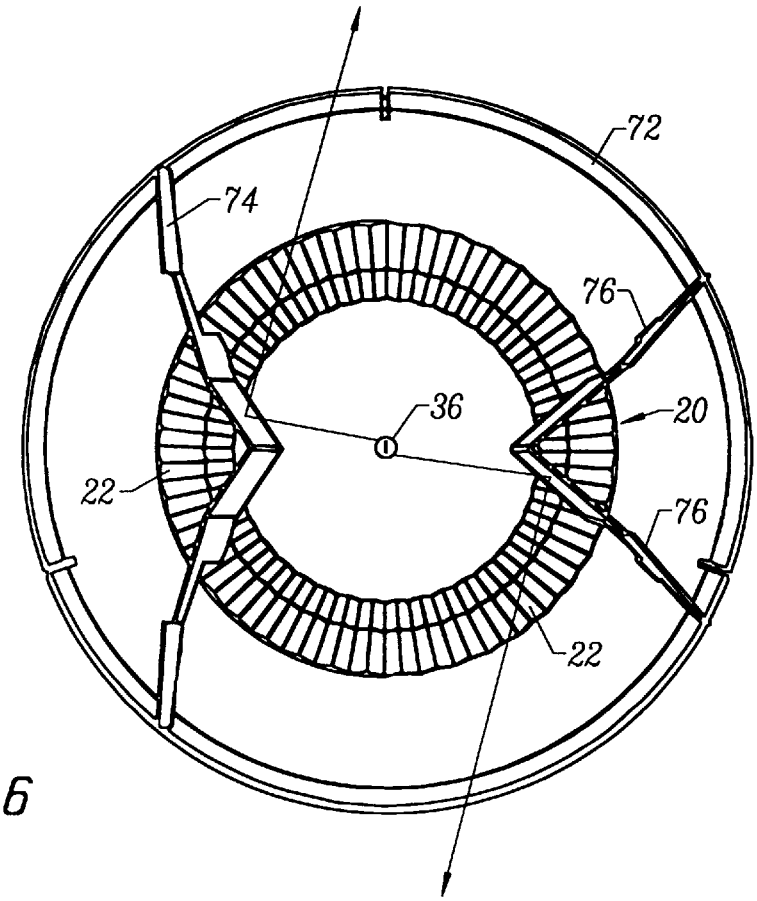
FIG. 6 is a sectional view taken along line 6—6 of FIG. 3.

Turning to FIGS. 5 and 6, it may be observed that light shields 74 and 76 are also shown in the present invention. Light shields 74 and 76 are of the "butterfly wing" or "gull wing" configuration, and are capable of intercepting and reflecting light from source 36 in a direction generally opposite from the ray emanating from source 36. It should be apparent that shield 74 is larger than shield 76 and, thus, intercepts a greater degree of light, creating an asymmetric distribution of light from device 10. Such type of fixture is normally referred to as a type III fixture, while a symmetric fixture without light shields is normally referred to as a type IV fixture.

Figure 1:
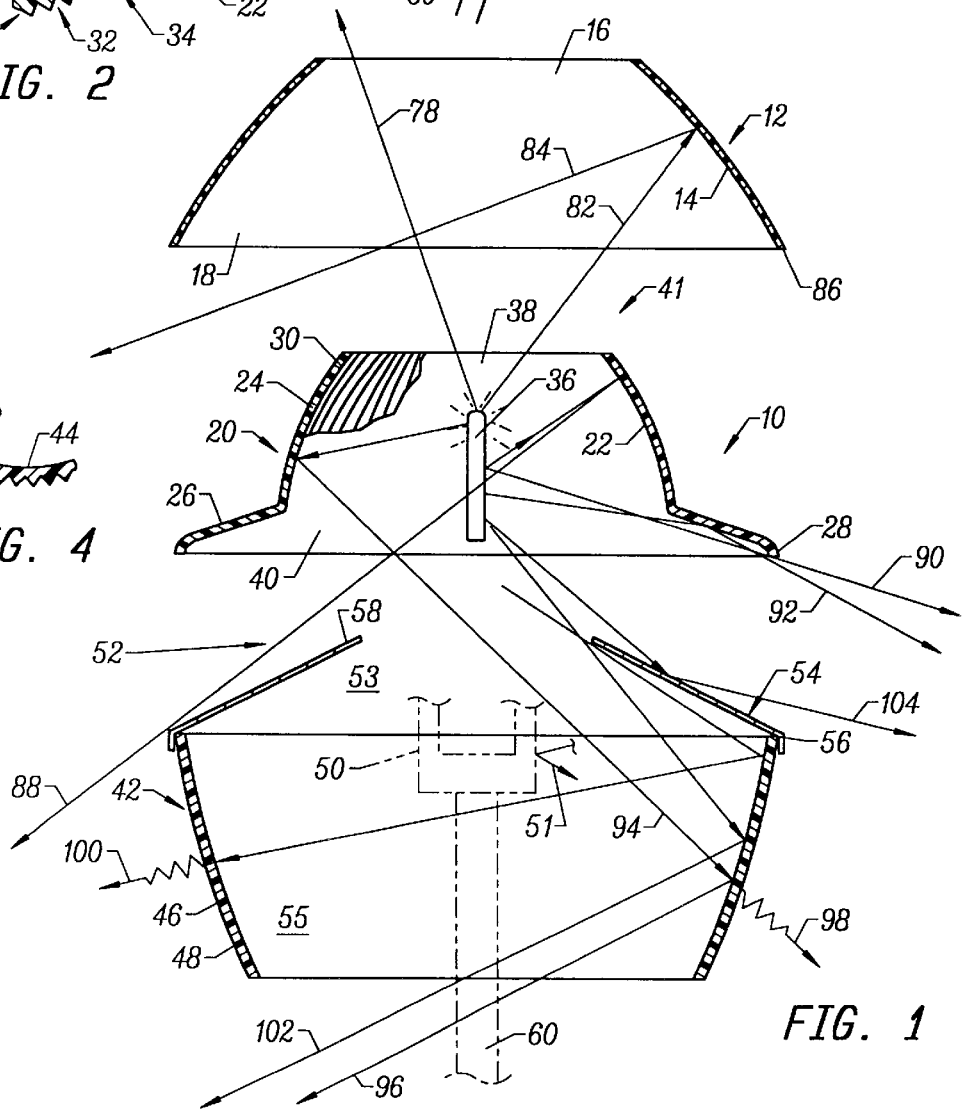
FIG. 1 is a sectional view of the lighting device of the present invention depicting typical ray lines from the source of light.

In operation, FIG. 1, light beginning at source 36 is permitted to pass directly upwardly through opening 16, ray 78. A globe 80, partially represented in FIG. 3, may enclose the very top of lighting globe 80 to capture light rays, such as ray 78 and illuminate the upper portion of device 10 with a perceived glow. Globe 80 may be particularly designed to fit device 10 or may be retrofitted from prior lighting devices, due to the compact characteristics of device 10. Rays represented by rays 82 and 84, emanate from source 36 and reflect off surface 14 of first reflector 12 and through first gap 41 therebetween at angles typically ranging between 650 and 72°. The edge 86 of first reflector 12 serves as a glare cut off for light shone at such angles. It should be apparent that opening 38 permits rays 78 and 82 to escape from source 36 without interaction with second reflector 20. Exemplary compound ray 88 from source 36 reflects off reflecting surface 22 of second reflector 20 and passes through gap 52, at about 70°. Fluted surface 22 insures that light represented by ray 88 is not directed back through source 36. Ray 90 directly emanating from source 36 also passes through gap 52 and is represented in FIG. 1 as being at the cut off angle determined by edge portion 28 of second reflector 20, i.e., in the 68°–90° range. Compound ray 92, on the other hand, emanates from source 36 and reflects off reflecting surface 22 found at second portion of reflector 20 at an angle less than the cut off angle represented by ray 90 i.e., in the 34°–56° range. Ray 94 from source 36 reflects off reflecting surface 22 of second reflector 20 and passes to light interacting element 42. Ray 96 depicts the reflection of ray 94 from reflecting surface 44 of light interacting element 42 while ray 98 represents diffusion of light through light interacting element 42. Compound ray 100 also follows a path similar to compound ray 98 but at a higher angle in diffusing through light interacting element 42. The reflected ray is not depicted with respect to ray 100 in this regard. Also, compound ray 102 represents light passing through opening 55 of light interacting element 42, absent the diffusing ray as shown by compound ray 98. Both rays 96 and 102 lie in the range of about 67°–75°. It should be noted that compound rays 96 and 102 also enter light interacting element 42 through opening 53 thereabove from reflecting surface 22 and directly from source 36, respectively. Third reflector 54 also reflects light from source 36 as is depicted by compound ray 104, i.e., at a high angle light of less than 83°, typically 60°–82°. It has been found that device 10 is capable of controlling light in various ways at high angles with a glare cut off afforded by edge portions 28 of second reflector 20 and edge portion 86 of first reflector 12. In addition, the reflecting/diffusing characteristic of light reflecting element 42 eliminates glare at the lower portion of device 10, which is aesthetically pleasing.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A lighting device having a source of light, comprising:

a. a first reflector positioned outwardly from the source of light;

b. a second reflector at least partially surrounding the light source said second reflector being spaced from said first reflector to form a first gap therebetween; said second reflector receiving light from the source and directing the received light away from the first reflector, said second reflector further including an opening permitting passage of light from the source to said first reflector for directing light received from said first reflector through said first gap between said first and second reflectors;

c. a light interacting element positioned outwardly from the source of light, said second reflector positioned between said first reflector and said light interacting element, said light interacting element being spaced from said second reflector to form a second gap therebetween, said light interacting element reflecting light from the source outwardly from the source, said light interacting element further passing light therethrough; and d. a third reflector, said third reflector positioned between said second reflector and said light interacting element, said third reflector receiving light from source of light and directing the received light through said second gap.

2. The lighting device of claim 1 in which said light interacting element is a diffuser.

3. The lighting device of claim 2 in which said second reflector includes an inner reflecting surface and an outer surface, said inner reflecting surface including a plurality of spaced ridges, said plurality of ridges having a plurality of surfaces reflecting light received from the source of light away from the source of light.

4. The lighting device of claim 1 in which said third reflector is mechanically connected to said light interacting element.

5. The lighting device of claim 1 in which said light interacting element further receives light reflected from said second reflector for reflection from said light interacting element and for passing through said light interacting element.

6. The lighting device of claim 1 in which said first reflector includes an opening therethrough for the passage of light outwardly therefrom, said opening being spaced from said first gap.

7. A lighting device having a source of light, comprising:

a. a first reflector positioned outwardly from the source of light;

b. a second reflector at least partially surrounding the light source said second reflector being spaced from said first reflector to form a first gap therebetween; said second reflector receiving light from the source and directing the received light away from the first reflector, said second reflector further including an opening permitting passage of light from the source to said first reflector for directing light received from said first reflector through said first gap between said first and second reflectors, said second reflector including a flange for cutting off light emanating through a second gap; and c. a light interacting element positioned outwardly from the source of light, said second reflector positioned between said first reflector and said light interacting element, said light interacting element being spaced from said second reflector to form said second gap therebetween, said light interacting element reflecting light from the source outwardly from the source, said light interacting element further passing light therethrough.

8. A lighting device having a source of light, comprising:

a. a first reflector positioned outwardly from the source of light;

b. a second reflector at least partially surrounding the light source said second reflector being spaced from said first reflector to form a first gap therebetween; said second reflector receiving light from the source and directing the received light away from the first reflector, said second reflector further including an opening permitting passage of light from the source to said first reflector for directing light received from said first reflector through said first gap between said first and second reflectors;

c. a light interacting element positioned outwardly from the source of light, said second reflector positioned between said first reflector and said light interacting element, said light interacting element being spaced from said second reflector to form a second gap therebetween, said light interacting element reflecting light from the source outwardly from the source, said light interacting element further passing light therethrough; and d. light shield means for interrupting light, said light shield means located between said second reflector and the source of light.

9. The lighting device of claim 8 in which said light shield means comprises a first light shield and second light shield said first light shield having a surface for interrupting light larger than a surface for interrupting light found on said second light shield.

10. The lighting device of claim 9 in which said light interrupting surfaces of said first and second light shield comprise light reflecting surfaces.

11. A lighting device having a source of light, comprising:

a. a first reflector positioned outwardly from the source of light;

b. a second reflector at least partially surrounding the light source said second reflector being spaced from said first reflector to form a first gap therebetween; said second reflector receiving light from the source and directing the received light away from the first reflector, said second reflector further including an opening permitting passage of light from the source to said first reflector for directing light received from said first reflector through said first gap between said first and second reflectors; and c. a light interacting element positioned outwardly from the source of light, said second reflector positioned between said first reflector and said light interacting element, said light interacting element being spaced from said second reflector to form a second gap therebetween, said lighting interacting element reflecting light from the source outwardly from the source, said light interacting element further passing light therethrough, said second gap permitting light from the source to pass directly, outwardly from the source without reflection.

* * * * *